US005827401A

United States Patent [19]

Backlund et al.

[11] Patent Number: 5,827,401

[45] Date of Patent: Oct. 27, 1998

[54] SCREEN SYSTEM FOR A CONTINUOUS DIGESTER

[75] Inventors: Ake Backlund; Kenneth Bellstrom; Finn Oulie; Johanna Svanberg; Soren Soderqvist, all of Karlstad, Sweden

[73] Assignee: Kvaerner Pulping Technologies AB, Karlstad, Sweden

[21] Appl. No.: 784,808

[22] Filed: Jan. 16, 1997

Related U.S. Application Data

[63] Continuation of Ser. No. 639,532, May 1, 1996, abandoned, which is a continuation of Ser. No. 415,203, Mar. 31, 1995, Pat. No. 5,567,280, which is a continuation of Ser. No. 130,558, Oct. 1, 1993, abandoned.

[30] Foreign Application Priority Data

Nov. 18, 1992 [SE] Sweden ..... 9203462

[51] Int. Cl.[6] ..... D21C 7/14

[52] U.S. Cl. ..... 162/248; 162/251; 210/162

[58] Field of Search ..... 162/237, 248, 162/249, 250, 251; 210/162, 413, 498

[56] References Cited

U.S. PATENT DOCUMENTS

| | | | |
|---|---|---|---|
| 2,414,062 | 1/1947 | Richter | 162/237 |
| 2,998,064 | 8/1961 | Lang | 162/251 |
| 3,836,463 | 9/1974 | Teague et al. | 210/162 |
| 4,630,138 | 12/1986 | Utsugi et al. | 360/33.1 |

FOREIGN PATENT DOCUMENTS

| | | |
|---|---|---|
| 2037717 | 3/1992 | Canada . |
| 92578 | 10/1958 | Norway . |
| 211196 | 7/1966 | Sweden . |
| 130485 | 9/1974 | Sweden . |

OTHER PUBLICATIONS

Kamyr Inc Drawing 0–0701–1R32, 1968.

Backlund, A.E., "Extended delignification of softwood kraft pulp in a continuous digester", Nov. 1984, Tappi Journal, pp. 62–65.

*Primary Examiner*—Donald E. Czaja
*Assistant Examiner*—Dean T. Nguyen
*Attorney, Agent, or Firm*—Cushman Darby & Cushman Intellectual Property Group of Pillsbury Madison & Sutro LLP

[57] ABSTRACT

A screen system for a digester for continuous cooking under raised pressure and temperature of fiber material in a vertical vessel, where input of fiber material and cooking liquid takes place at the top of the digester, withdrawal of spent cooking liquor is carried out from at least one digester screening arrangement (1D) between the top and the bottom of the digester, and fiber material is fed out from the bottom (1C) of the digester, wherein at least one of said screening arrangements (1, 2) has at least one screen element (2A) of which the main configuration is circular and which is assembled by means of welding, and which is fitted into the digester shell by means of welding.

10 Claims, 9 Drawing Sheets

After Cooking
After Oxygen Delignification
Viscosity ( dm3/kg )
1200
1150
1100
1050
1000
950
5
10
15
20
25
30
Kappa No.

SCREEN SYSTEM FOR A CONTINUOUS DIGESTER

This is a continuation of application Ser. No. 08/639,532, filed on May 1, 1996, which was abandoned upon the filing hereof, which was a continuation of Ser. No. 08/415,203, filed Mar. 31, 1995 now U.S. Pat. No. 5,567,280, which was a continuation of Ser. No. 08/130,558, filed Oct. 1, 1993, now abandoned.

FIELD OF THE INVENTION

This invention relates to pulp digesters and, more specifically, to an improvement screening structure for pulp digesters.

BACKGROUND OF THE INVENTION

The environmental authorities are placing ever more stringent demands on the pulp industry to decrease the use of chemicals which can be damaging to the environment, such as, for example, chlorine. Thus, permitted discharges of organic chlorine compounds in the waste water from bleaching plants, following on from the cooking process, have been decreased progressively and are now at such a low level that pulp factories have in many cases stopped using organic chlorine compounds as bleaching agents. In addition, market forces are tending progressively to increase the demand for paper products which are not bleached with chlorine.

The pulp industry is therefore searching for methods which allow bleaching of pulp without using these chemicals. The lignox method (see SE-A 8902058), in which, inter alia, bleaching is carried out with hydrogen peroxide, may be mentioned as an example of such a method. Ozone is another interesting bleaching chemical which is also gaining increased application. It is thus possible, using bleaching chemicals of this nature, to achieve those brightnesses which are required for marketable pulp, i.e. 89 ISO and greater, without using chlorine-containing bleaching agents.

There is, however, a problem in using presently-known bleaching procedures with these bleaching chemicals which do not contain chlorine, namely that they have a significant effect in diminishing the quality of the pulp fibres.

By means of experiments which have been conducted under the auspices of Kamyr AB, it has been found, surprisingly, that extremely good results, with regard to delignification and strength properties, can be obtained if the pulp is cooked at the same temperature level in principally the whole of the digester, i.e. if essentially the same temperature is maintained in all cooking zones, and if a certain quantity of alkali is also supplied to the lowest zone in the digester, which zone is normally used for counter-current washing. Owing to the fact that essentially the same temperature level is maintained in virtually the whole of the digester, very extensive delignification can be achieved at a relatively low temperature. Besides this, it has been found that the strength properties are affected in a particularly favorable manner, that a higher yield of the crude fibre product is obtained and that the quantity of reject material decreases. These advantages are most clearly apparent from the diagrams shown in the FIGS. 1 and 2, which show comparative values between pulp (softwood) which has been cooked using a conventional, modified cooking technique and pulp which has been cooked using the process according to the invention, (in a similar digester, i.e. with a concurrent upper cooking zone, a central counter-current cooking zone and a bottom counter-current washing zone) in which a constant temperature level of about +155° C. has been maintained in the whole digester.

The invention especially relates to (but not exclusively) an advantageous arrangement of a set of apparatus for achieving a cooking according to the new process such as is disclosed in copending U.S. application Ser. No. 08/051,396, filed Apr. 23, 1993, the disclosure of which is incorporated herein by reference. In particular with regard to digesters built according to an older principle, the present invention is also applicable where the process consists of an upper concurrent cooking zone and a lower counter-current washing zone. Such an arrangement is necessary since certain practical problems arise as a consequence of an isothermal cooking process. The first such problem is the difficulty of efficiently reaching and maintaining the temperature in the lower part of the digester, i.e. that part which is normally employed for washing.

The main object is to create a more efficient screening means in order to improve the circulation and as a consequence also the temperature distribution in the digester. In this context it has been found to be advantageous to use digester screening arrangements including circular screens, especially in connection with converting existing digesters, both of the modified type and the older type, for operation according to the new process, but also in connection with building of new digesters.

DETAILED DESCRIPTION

Figure 1A:
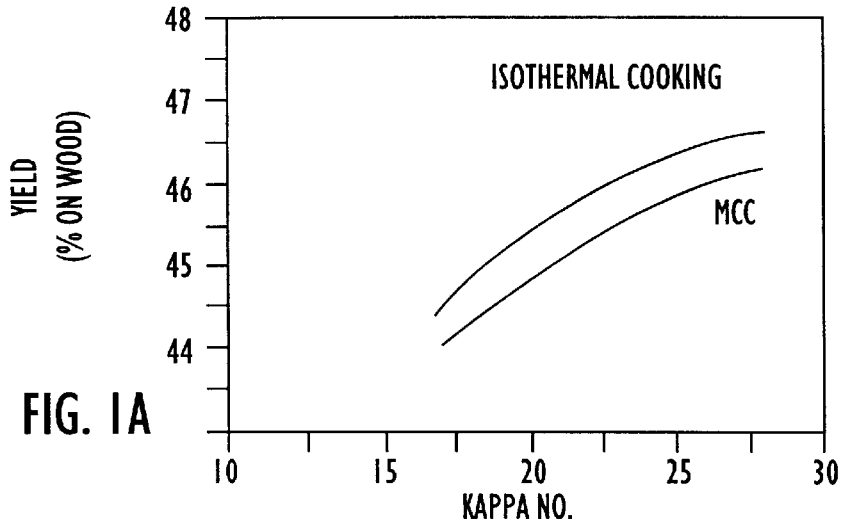
FIGS. 1A, 1B and 1C shows a comparison in three diagrams between isothermal cooking and so-called modified conventional cooking (MCC)
Figure 1B:
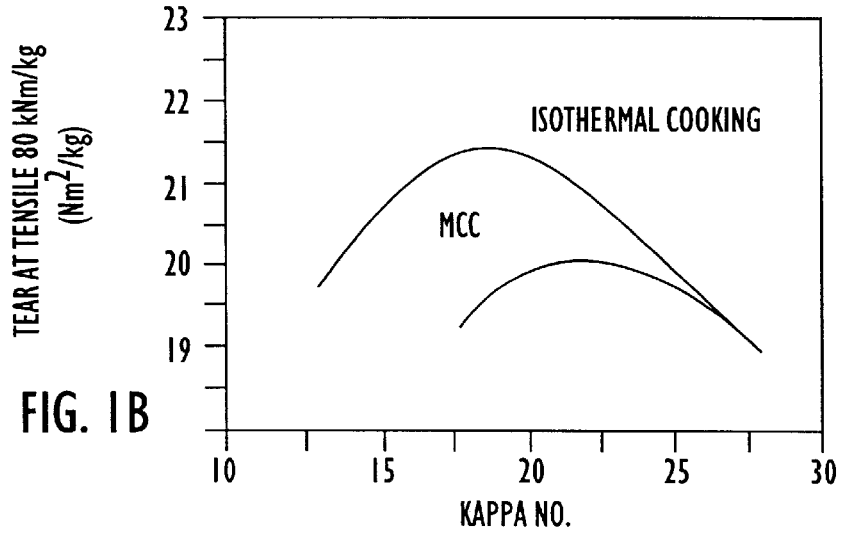
Figure 1C:
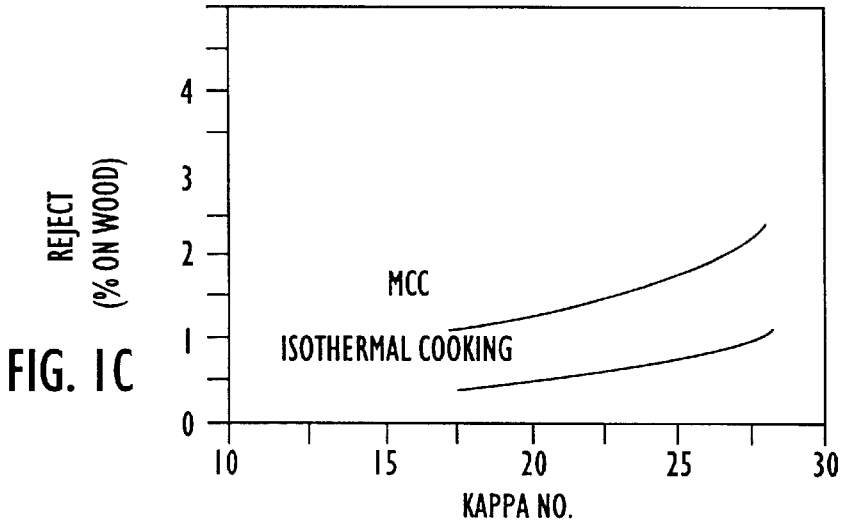
Figure 2:
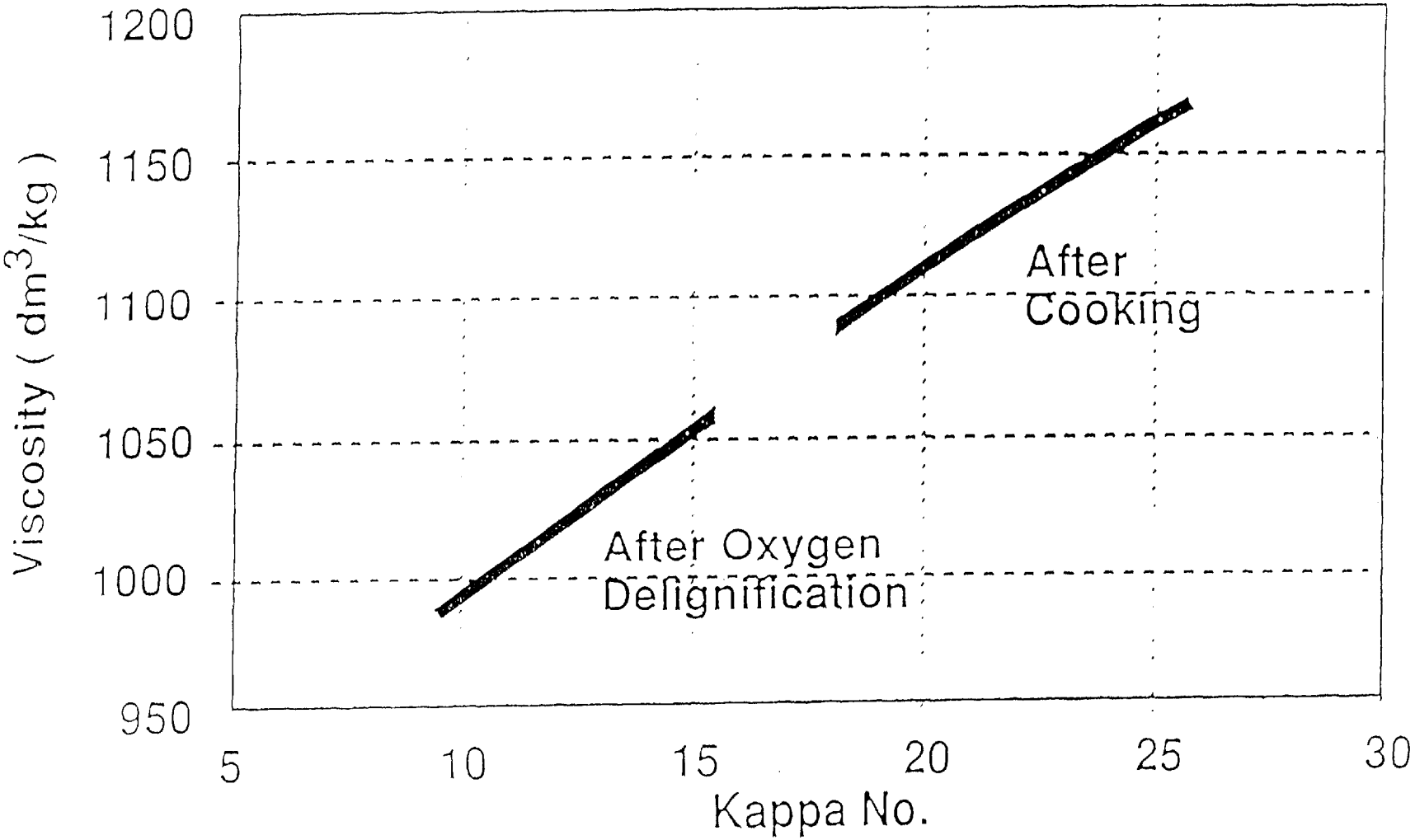
FIG. 2 shows a diagram which describes degree of delignification and viscosity (the viscosity is normally regarded as indicating the strength properties of the pulp)

FIGS. 1A, 1B and 1C shows three diagrams which compare different results obtained with isothermal cooking and conventional modified cooking (MCC). These surprisingly positive results show, according to the upper diagram, that, with a given amount of added alkali, substantially lower kappa numbers are obtained using isothermal cooking. Furthermore, the second diagram shows that manifestly improved strength properties are obtained when cooking down to the same kappa number. In addition, the third diagram shows that there is also the advantage that the quantity of reject wood (shives) decreases. If the fact is also taken into account that overall substantial energy savings are made when the temperature level is kept constant, it is evident that the results may be regarded as being surprisingly positive. FIG. 2 additionally demonstrates that, using the method according to the invention, very low kappa numbers are reached while at the same time retaining good pulp strength (viscosity of about 1000) after oxygen delignification. Thus, when employing the method according to the invention, so-called environmentally friendly bleaching chemicals, such as peroxide and ozone, can be employed in subsequent bleaching stages without risking too low a strength for bleaching up to the level of brightness, and therewith also the level of purity, which the market demands.

Figure 3A:
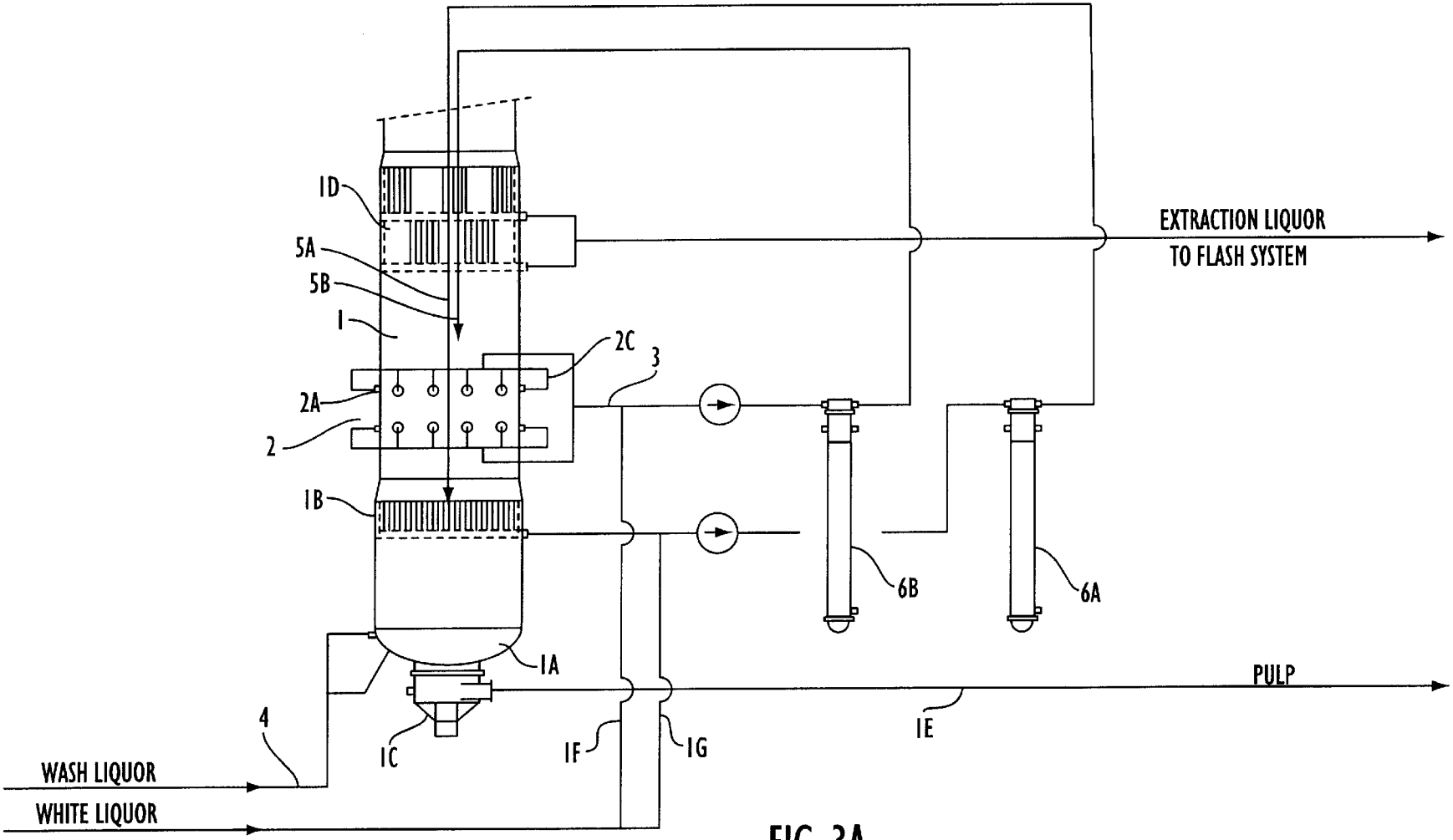
FIGS. 3A, 3B and 3C show an existing digester converted, using circular screens, to be operated according to the novel process with FIGS. 3D and 3E showing on an enlarged scale the indicated portion of the associated drawing.

FIG. 3A shows the lower part of a digester 1, which is intended to represent an existing digester shell on which has been arranged a new digester screening arrangement 2 in order to be able to raise the temperature in the counter-current zone. The digester is of the type which has an upper concurrent part and a lower counter-current part. In such a digester, full cooking temperature is normally maintained in the concurrent zone (i.e. about 162° C. for hardwood and about 168° C. for softwood) while in the counter-current part, which in the main is a washing zone, the temperature is about 135° C. on a level with the lower screen.

In the following text, the counter-current zone of the digester which has been fitted with a further screening arrangement will be referred to as a cooking zone, even if it is to be considered as a washing zone according to conventional operation.

The new digester screening arrangement 2 (in FIG. 3A) comprises a number of circular screens 2A for withdrawal through conduit 3 of cooking liquid in the lower part of the digester. The screens 2A are arranged immediately above the lower screening arrangement 1B, preferably at most 1.5 meters above and more preferably at most 1 meter above, measured from the upper edge of the lower digester screening arrangement to the lower edge of the newly fitted digester screening arrangement. Wash liquor is supplied to the lower part of the digester through an inflow arrangement 4 attached in the vicinity of the bottom 1A of the digester and cooking liquid (alkali addition) through the central pipes 5A, 5B. The cooked pulp is taken out from the bottom of the digester via a conduit 1E.

One of these central pipes, 5A, which extends generally parallel to the vertical longitudinal axis of the vessel and which belongs to the original system of the digester, penetrates down to the lower screening arrangement 1B of the digester, after which the liquid, after heating via the first heat exchanger 6A, discharges through the said pipe on a level with the latter digester screening arrangement. Subsequently, a part of the liquid flows in a counter-current direction upwards towards the newly fitted digester screening arrangement 2. The liquid withdrawn from this system passes through the said conduit arrangement 3 and is heated via a heat exchanger 6B to the desired temperature before it discharges, via a second, newly fitted central pipe 5B, immediately above the newly fitted digester screening arrangement 2. A part of the cooking liquid supplied in this manner, which liquid has thus reached the desired temperature (e.g. 158° C.), chemical strength and distribution (spreading) over the whole of the cross-section of the digester, continues to flow upwardly in the digester. In a central digester screening arrangement 1D, the spent cooking liquid, together with undissolved wood material, is drawn off for further treatment.

The surface of each screening element 2A is made relatively small, preferably less than 0.3 $m^2$. An advantage of screening elements of small area is that efficient back flushing can be achieved, which is often of great importance if the circulation flow is to function efficiently. The new screening arrangement 2 is preferably fitted with ring pipes 2C from which an individual conduit goes to each and every one of the screening elements 2A. Using such a construction, and a valve arrangement belonging to it, a limited number (for example 4) of screening units 2A can be efficiently back-flushed at a time. Owing to the relatively small total screening surface which is back-flushed under these circumstances (for example 0,5–1 $m^2$), a very efficient back-flushing which cleans the screens is obtained, thereby ensuring that the circulation is highly efficient.

Figures 3B, 3D:
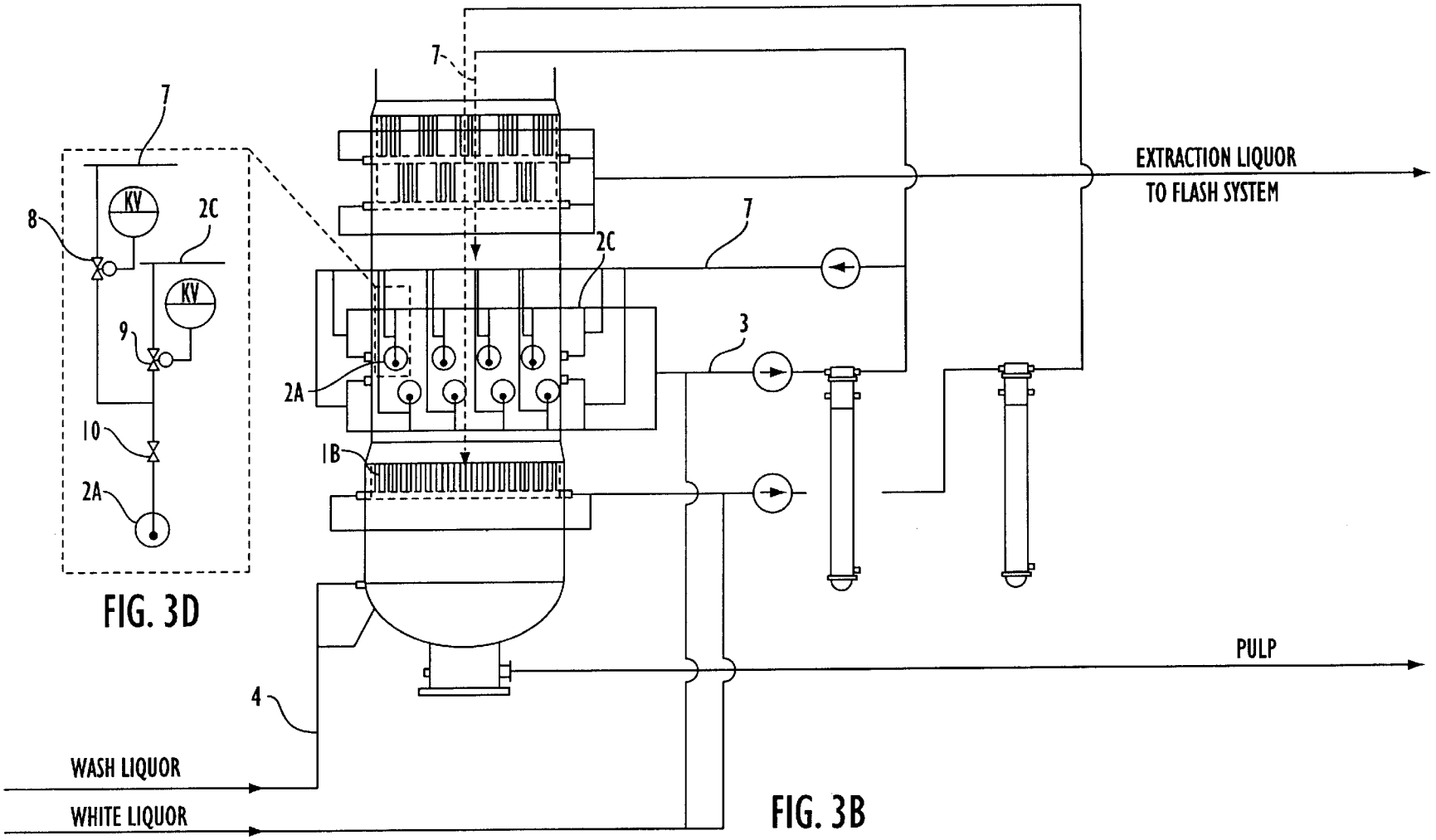

In FIG. 3B, there is shown a first embodiment of how such a back flushing system can be arranged. Also, as shown in FIG. 3B, the screens 2A in each row are substantially evenly spaced about the wall of the digester as shown. The back flushing liquid is collected via a branch conduit 7 (the main conduit for back flushing) from the liquid which circulates from the circular screens 2A via conduit 3 and out through central pipe 5B. The liquid which is fed into the main back flushing conduit 7 is there after sequentially fed to the different screens 2A by means of a number of valves 8, 9 (see FIG. 3D, an enlarged part of FIG. 3B).

Beside the two valves needed for each screen 2A for providing the back flushing there is also provided a main valve 10 which provides for the possibility of shutting off the liquid supply from and to a screen totally. The liquid is withdrawn from the screen element 2A via a ring pipe 2C (and further via main pipe 3) and accordingly the main valve 10 and withdrawal valve 9 would then be opened whereas the back flushing valve 8 would then be closed.

During back flushing, the main valve 10 is opened, the withdrawal valve 9 is closed and the back flushing valve 8 opened. Preferably this is performed in a sequential manner so that four screens are closed for back flushing (e.g. all four at the same time) meanwhile the remaining screens, e.g. 20 screens, would withdraw liquid. Hence preferably the pressure in the main conduit for back flushing 7 would be substantially equal. Instead of back flushing all four screens at the same time it is possible to back flush them two and two in order to increase the flow over each screen.

Figures 3C, 3E:
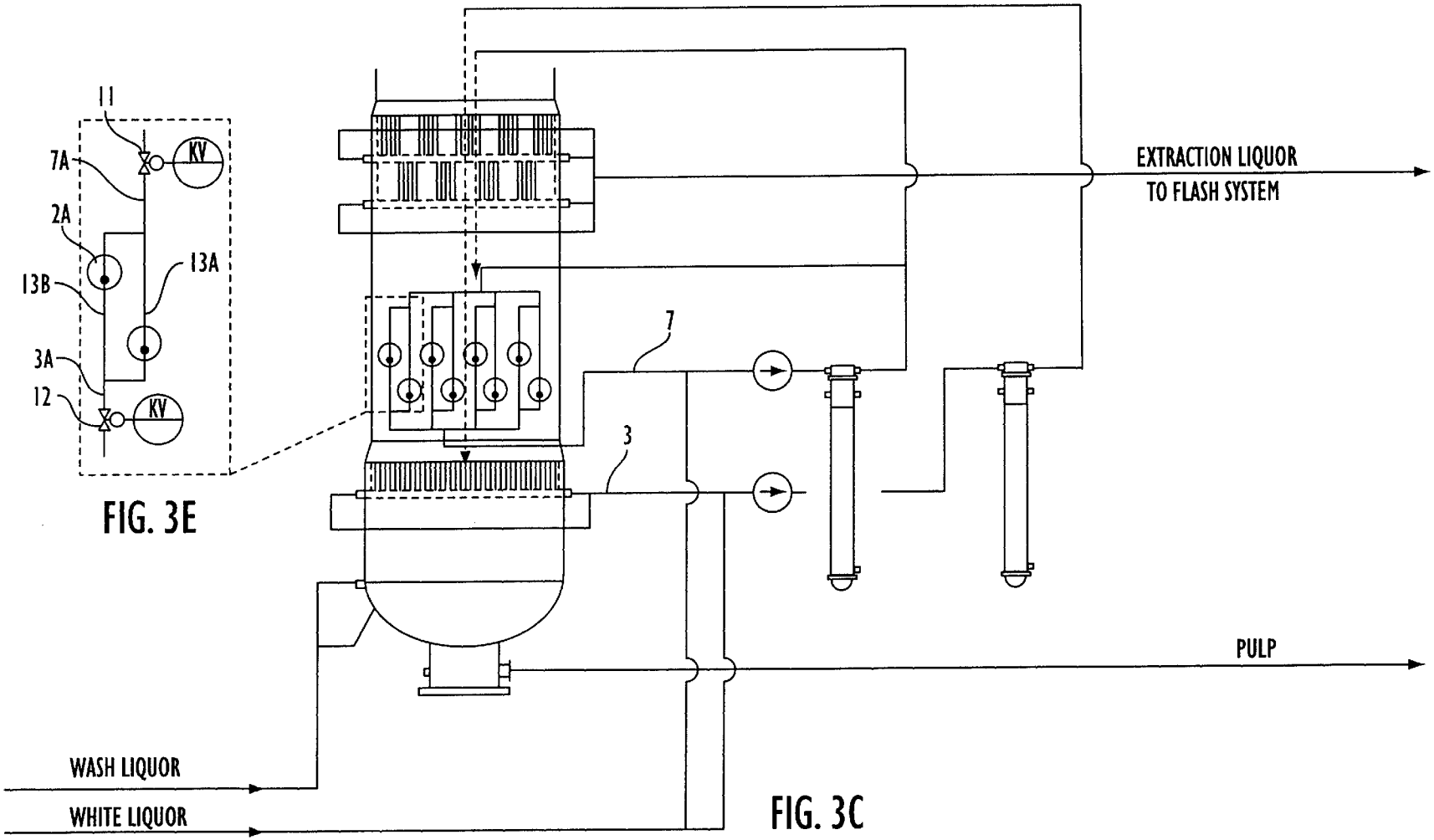

In FIG. 3C, there is shown a preferred embodiment of how to arrange a back flushing system. A main conduit 3 for withdrawal of a liquid and main pipe 7 for the supply of back flushing liquid are provided as shown. Two screen systems 2A are interconnected with each other via a conduit forming a loop. This loop has an upper part 13A interconnected with the back flushing conduit 7 via branch conduit 7A. A valve 11 is arranged in this branch conduit 7A. The lower part of the loop 13B is interconnected with a branch conduit 3A which is joined with the withdrawal conduit 3. A valve 12 is fitted in the withdrawal branch conduit 3A. During withdrawal the valve 11 in the upper branch conduit 7A would be closed whereas the withdrawal valve 12 would be opened. Liquid will then be withdrawn from both of the screens 2A via the lower part of the loop 13B, as shown in FIG. 3C and the branch conduit 3A and further into the withdrawal conduit 3. During back flushing, which is performed sequentially, the upper valve 11 will open and the lower valve 12 will close and the back flushing liquid will then be introduced via branch pipe 7A through the upper part of the loop 13A into both of the screens 2A in order to rinse the screen faces. The advantage with the latter described embodiment is that the number of valves required is reduced, in relation to a conventional arrangement.

Figure 4:
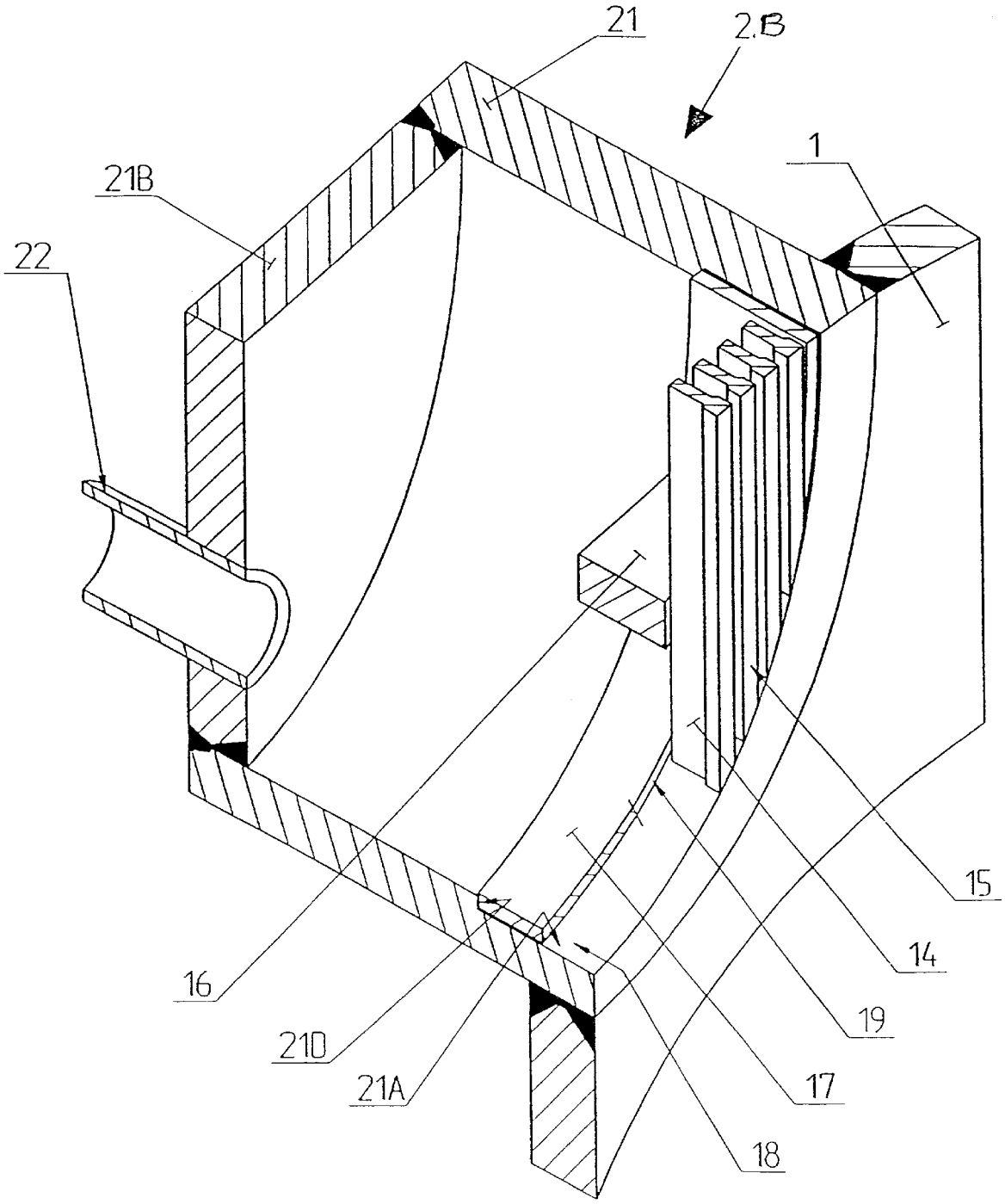
FIG. 4 shows a cross sectional perspective view of a preferred embodiment of a circular screen according to the invention.
Figure 5:
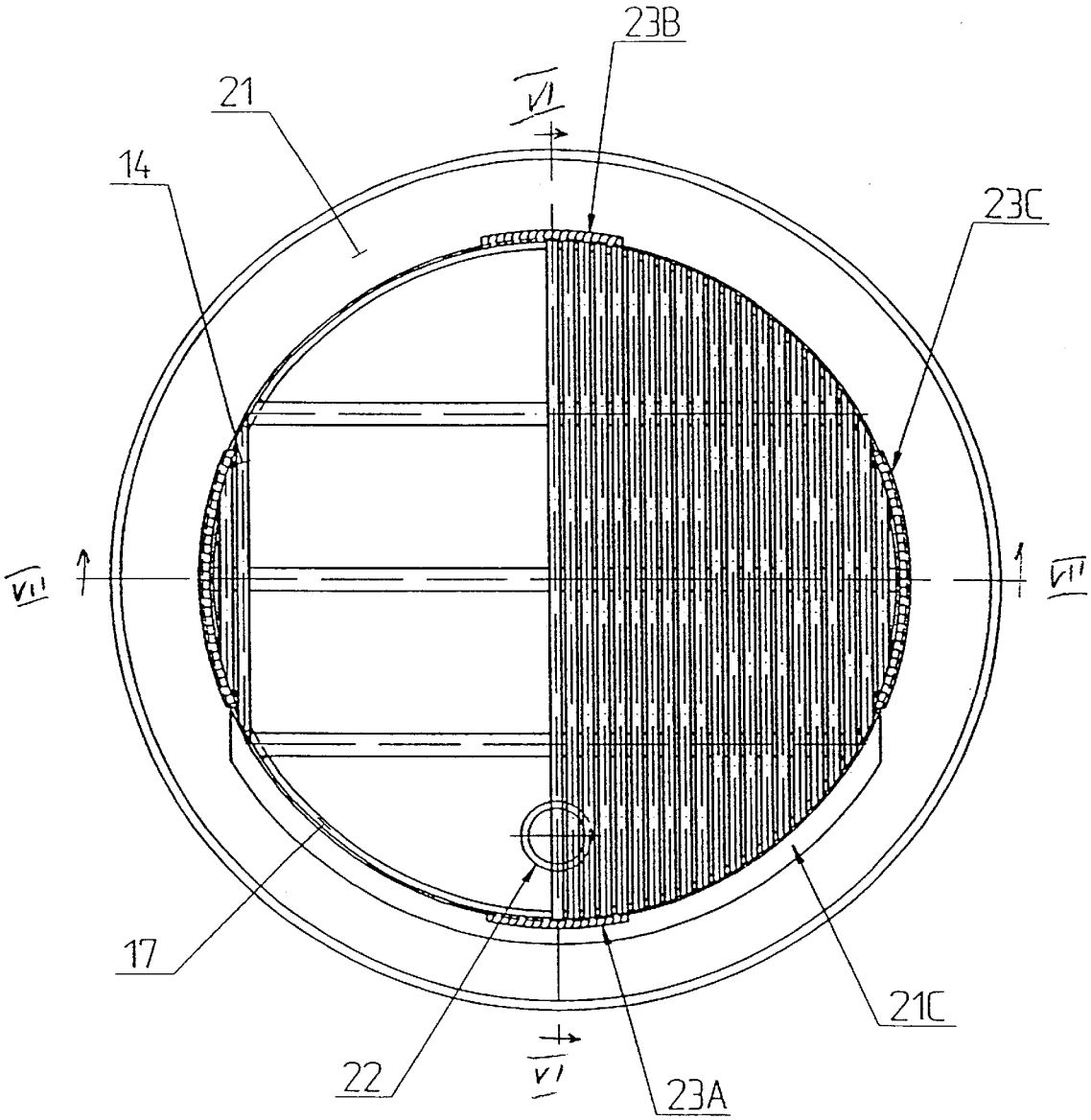
FIG. 5 shows a screen of FIG. 4 seen from the inside of the digester vessel.

In FIGS. 4–7, the design of a preferred screen element 2B of the system 2A is shown. The screen 2B is shown fitted onto the digester wall 1. The screen is of the rod screen type, wherein rods 14 are used to form the screen face 15. The rods are supported by, preferably horizontal as installed, bars 16, which preferably would be made of stainless steel having a very high quality whereby preferably the hardness RP would exceed 200 Megapascals and more preferably 300 MPa. The rods 14 are welded onto the bars 16. Furthermore, the screen 2B also includes an annulus 17 which preferably consists of a plate bent in the form of a ring. At the top and the bottom of this annulus 17 there are provided recesses 18, so that an inwardly facing edge 19 is formed against which the top and bottom ends respectively of a rod 14 can rest as shown in FIG. 5. Preferably, at least two or three of the bars 16 are welded within the annulus 17 so that inwardly facing edge of each bar 16 is coplanar with said facing edge 19 of the annulus 17. Accordingly the rods 14 are supported not only by the bars 16 but also by said edge 19 of the annulus 17 (see FIG. 6). An advantage with this arrangement is that the screen faces 15 then can be installed in a manner to avoid any edges projecting into the vessel which could cause the downwardly moving pulp to hang. The annulus 17 with the rods 14 and bars 16, is fitted within a hollow housing element 21, which preferably is in the form of a forged cylinder 21. The cylinder housing 21 has a groove 21A (preferably machined therein) which is intended to receive the annulus 17, so that the annulus 17 can rest on the inwardly facing edge 21D of said groove 21A. Furthermore, the cylinder 21 is provided with a seal plate 21B through which an inlet and outlet pipe 22 protrudes. As shown in FIG. 5, the lower inner part of the cylinder 21 has a large tapered arc portion 21C in order to further eliminate possible risks of hanging of the pulp. A further object of this tapered portion 21C is to provide for attachment of the annulus 17 within said cylinder 21 by means of a weld 23A in the bottom region, away from the screen face 15 without creating any edges, which could cause hanging. This weld 23A can be performed in one piece, thanks to the rods 14 being positioned in the recess 18 in the annulus 17.

In FIG. 5, there is shown the screen preferably fitted within the cylinder 21 by means of welds 23A, B, C. Preferably four welds are used, one weld at the bottom 23A and one at the top 23B and two on each side 23C. It should be noted that the weld at the top 23B need not be fitted within a large tapered portion (but possibly in a ground groove) since the possible disturbing edges caused by this weld can be eliminated by means of grinding. The two welds at the sides will have no or little effect to the moving pulp since they are arranged along the part of the circle where they are almost vertical. This is important since otherwise the screen element would cause hanging of the pulp.

Figure 6:
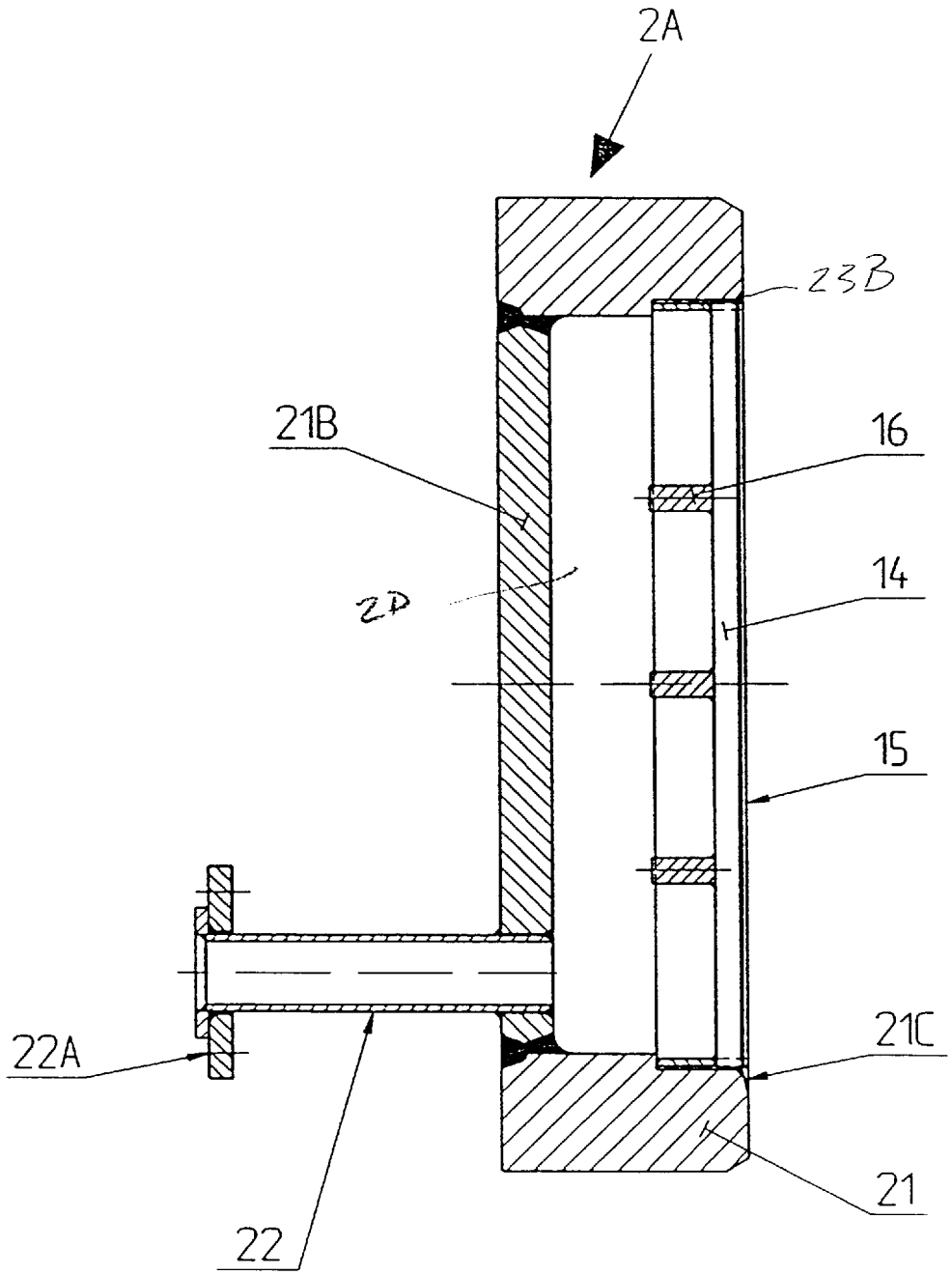
FIG. 6 is a vertical cross sectional view of the same.

In FIG. 6, there is a cross sectional view along the lines VI—VI of FIG. 5 which shows that the screen 2A has an outlet and an inlet duct 22 with fittings 22A in order to enable withdrawal of liquid as well as supply of back flushing liquid as described above.

Figure 7:
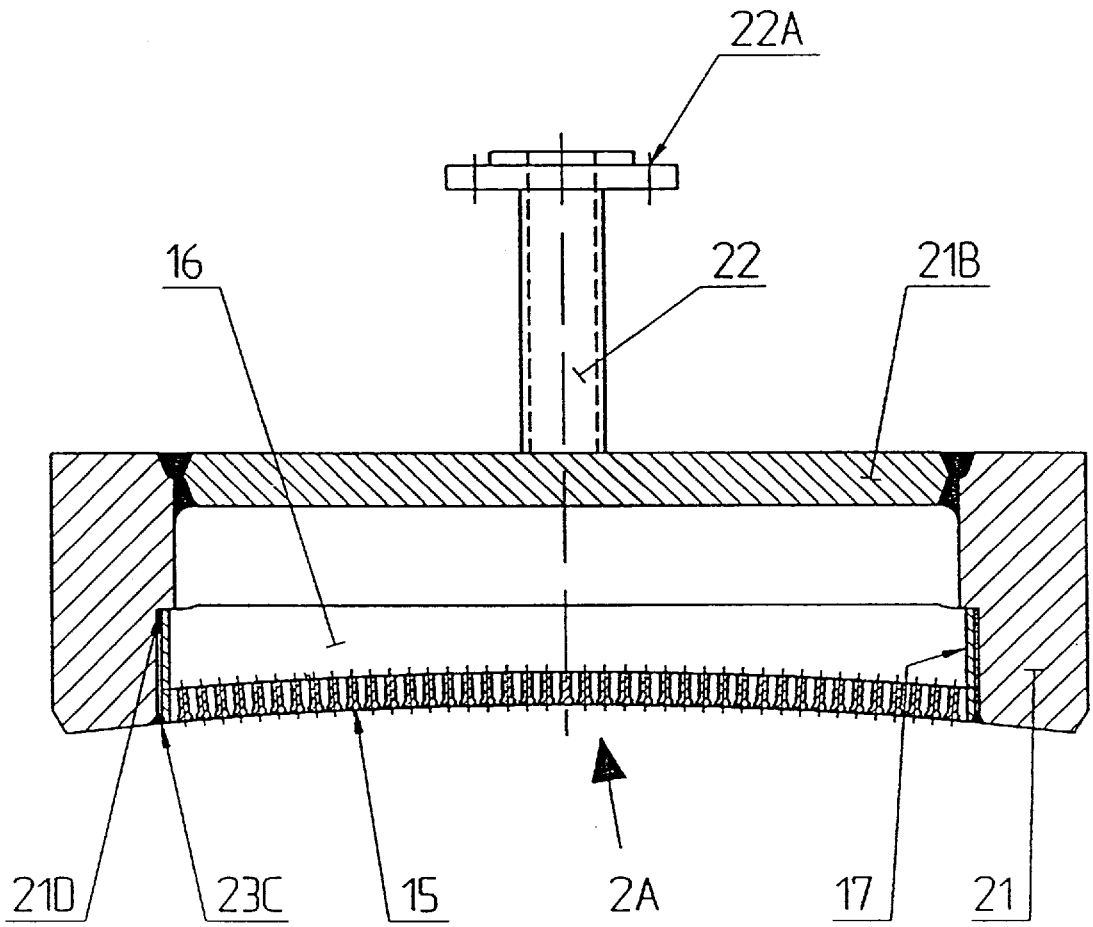
FIG. 7 is a horizontal cross sectional view of said preferred screen.

In FIG. 7, there is shown a cross sectional view along line VII—VII of a preferred screen element 2A. It should be noted that not only the annulus 17 rests upon the inwardly facing edge 21D of the groove 21A in the cylinder 21, but also the outer edge portions of the bars 16 rest on said edge 21D. Accordingly it is important that when the different parts 14, 16 and 17 forming the screen face have been assembled, the outer periphery of the back of said assembly is in alignment in order to rest evenly on said edge 21D. Preferably, said assembly 14, 16, 17 is machine cut in order to obtain said aligned surfaces. Furthermore, it should be noted that all attachments are made by welding. As shown in FIG. 4 also the cylinder 21 is welded onto place within the opening in the digester shell 1.

It is advantageous to use welding (compared to bolts) since sealing problems are avoided. Normally a screen element 2A according to the invention would first be assembled by welding the bars 16 into the annulus 17. The cylinder 21 with its sealing plate 21B would preferably be assembled thoroughly so that the pipe 22 with fittings 22A would also be put on place. Finally the screen face 15 is positioned within the cylinder 21 by means of welds, preferably as described above. When the screen face must be exchanged this can be performed from the inside of the digester vessel by eliminating (e.g. grinding) the welds 23 and thereafter taking out the screen face (parts 14, 16, 17) and replacing it with a new one. During production of the screens the cylindrical form is advantageous since many operations can then be easily duplicated. A further advantage is that the hole and the weld in the digester vessel will have an annular form which is an advantage concerning the structural strength of the vessel. When the screen face is changed there is also a major advantage residing in the fact that the piping (on the outside) need not be disassembled.

The invention is not limited by that which has been described above, but can be varied within the scope of the subsequent patent claims. Thus, an existing digester of the MCC type can also be arranged in accordance with the invention, where, therefore, the digester has an upper concurrent part, a central, mainly counter-current, part and a lower counter-current part, where addition of a part of the cooking liquid takes place in the said lower counter-current part, the so-called high-heat zone. A digester of the so-called hydraulic type, with a lower temperature in the upper part (the impregnation zone), may also advantageously be fitted with a digester screening arrangement according to the invention for cooking according to the invention, so-called isothermally. Additionally the preferred method may be used in connection with all types of cooking liquid, even if the method is principally intended for producing sulphate pulp. In addition, it is obvious to the person skilled in the art that the invention is not limited to the above mentioned exemplifying temperature levels. In this connection, however, it is important that the average temperature level in the digester preferably exceeds +150° C. but is lower than +165° C., and preferably is between 150°–155° C. for hardwood and between 160°–165° C. for softwood, and furthermore that the average temperature in the cooking zone or zones is preferably about +151° C. +−1° C., when the wood is hardwood, and that the average temperature in a digester is +159° C. +−1° C., when the wood is softwood. In addition, it is understood that screens deviating from a purely circular form, for example oval screens, may also be used, whereby, for technical reasons related to the construction, the smallest radius of curvature should preferably not fall below 0.2 m. Further it is stressed that both old and new digesters can be fitted with screens according to the invention. Further it should be noted that the basic design concept could also be used together with other screen faces than the rod-type, e.g. slotted screen faces. Moreover it should not be excluded that all screens are made of this circular type. Finally, it is possible to only let the outer casing 21 be circular and to have an angular screenface assembly (e.g. rectangular) positioned therein. Instead of letting the screenface assembly rest on an edge formed by a groove 21A, it could rest on non-integral parts, such as screws or the like.

What is claimed is:

1. In a pulp digesting vessel, having a generally cylindrical wall, a plurality of generally circularly shaped openings formed in said wall and each including a peripheral surface, at least some of said openings including a screen member extending across said respective opening to prevent the passage of particles of a selected size through said respective screen member, said cylindrical wall of said vessel supporting for each said screen member an enclosure surrounding each said opening externally of said vessel, each said enclosure including an outlet connected to a conduit, said screen member comprising a plurality of rods extending across said peripheral surface and being spaced apart from each other to span substantially a diameter of said opening, a supporting bar extending from one side of said opening to the opposite side, said bar having a front edge and said rods each being secured to said front edge of said bar, each said rod having opposite ends and said enclosure including a surface portion for supporting at least one of said ends of each of said rods.

2. The invention as claimed in claim 1, wherein each said screen member includes an annular member extending about said peripheral surface of said opening.

3. The invention as claimed in claim 2, wherein said peripheral surface of a said opening includes a recessed portion receiving said annular member.

4. The invention as claimed in claim 3 wherein said annular member is welded to a portion of said enclosure.

5. The invention as claimed in claim 4, wherein said screen member has a front face and said portion of said enclosure is remote from said front face.

6. The invention as claimed in claim 3, wherein said recessed portion has a selected axial depth and said annular member has an axial width that is less than said axial depth, said recessed portion including an inner edge against which said annular member engages.

7. The invention as claimed in claim 1, wherein a plurality of supporting bars are provided with front edges to which said rods are secured.

8. The invention as claimed in claim 7, wherein said rods are welded to said front edges of said supporting bars.

9. The invention as claimed in claim 7, wherein each of said bars has opposite ends which rest against said surface portion of said enclosure.

10. The invention as claimed in claim 1, wherein said bar has opposite ends which rest against said surface portion of said enclosure.

* * * * *